US011007807B2

(12) United States Patent
Chen et al.

(10) Patent No.: US 11,007,807 B2
(45) Date of Patent: May 18, 2021

(54) PRINTABLE RECORDING MEDIA

(71) Applicant: Hewlett-Packard Development Company, L.P., Spring, TX (US)

(72) Inventors: Tao Chen, San Diego, CA (US); Xulong Fu, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/462,484

(22) PCT Filed: Mar. 29, 2017

(86) PCT No.: PCT/US2017/024744
§ 371 (c)(1),
(2) Date: May 20, 2019

(87) PCT Pub. No.: WO2018/182593
PCT Pub. Date: Oct. 4, 2018

(65) Prior Publication Data
US 2019/0270330 A1 Sep. 5, 2019

(51) Int. Cl.
*B41M 5/50* (2006.01)
*B41M 5/52* (2006.01)

(52) U.S. Cl.
CPC ..... *B41M 5/5218* (2013.01); *B41M 5/508* (2013.01); *B41M 5/52* (2013.01); *B41M 5/5227* (2013.01); *B41M 5/5236* (2013.01); *B41M 5/5245* (2013.01); *B41M 5/5254* (2013.01); *B41M 5/5272* (2013.01)

(58) Field of Classification Search
CPC . B41M 5/5227; B41M 5/5245; B41M 5/5254
USPC ..... 428/32.34
See application file for complete search history.

(56) References Cited

U.S. PATENT DOCUMENTS

| | | | | |
|---|---|---|---|---|
| 8,053,044 | B2 | 11/2011 | Zhou et al. | |
| 8,092,873 | B2 | 1/2012 | Wang et al. | |
| 8,541,070 | B2 | 9/2013 | Wang et al. | |
| 8,795,796 | B2 | 8/2014 | Koenig et al. | |
| 9,375,967 | B2 | 6/2016 | Toles | |
| 9,434,201 | B2 | 9/2016 | Dannhauser et al. | |
| 9,475,329 | B2 | 10/2016 | Wingkono et al. | |
| 2007/0207278 | A1* | 9/2007 | Mukherjee | B41M 5/506 428/32.22 |

(Continued)

FOREIGN PATENT DOCUMENTS

| | | |
|---|---|---|
| CN | 101980872 | 2/2011 |
| CN | 102245719 | 11/2011 |

(Continued)

OTHER PUBLICATIONS

International Search Report dated Nov. 30, 2017 for PCT/US2017/024744, Applicant Hewlett-Packard Development Company, L.P.

*Primary Examiner* — Betelhem Shewareged
(74) *Attorney, Agent, or Firm* — Thorpe North & Western LLP

(57) ABSTRACT

A printable recording media comprising a supporting base substrate and a coating layer that contains a fixative agent and a binder system including a combination of water soluble binder and water dispersible binder. Also, described herein, is a method for making said printable recording media.

18 Claims, 2 Drawing Sheets

(56) References Cited

U.S. PATENT DOCUMENTS

| | | | | |
|---|---|---|---|---|
| 2009/0035478 | A1* | 2/2009 | Zhou | B41M 5/52 427/466 |
| 2011/0244148 | A1* | 10/2011 | Zhou | D21H 19/38 428/32.38 |
| 2012/0107531 | A1* | 5/2012 | Idei | B41M 5/508 428/32.31 |
| 2014/0139601 | A1* | 5/2014 | Pal | B41M 5/506 347/105 |
| 2016/0271987 | A1 | 9/2016 | Toles et al. | |

FOREIGN PATENT DOCUMENTS

| | | |
|---|---|---|
| CN | 102378693 | 3/2012 |
| CN | 103796840 | 5/2014 |
| CN | 104918790 | 9/2015 |
| CN | 104936792 | 9/2015 |
| CN | 105705339 | 6/2016 |
| CN | 105899368 | 8/2016 |
| JP | 2006096797 | 4/2006 |
| JP | 2012077394 | 4/2012 |
| JP | 2015164777 | 9/2015 |
| WO | 2009018370 | 2/2009 |

* cited by examiner

PRINTABLE RECORDING MEDIA

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for many reasons, including low printer noise, capability of high-speed recording and multi-color recording. Inkjet web printing is a technology that is specifically well adapted for commercial and industrial printing.

It has rapidly become apparent that the image quality of printed images using such printing technology is strongly dependent on the construction of the recording media used. Consequently, improved recording media, often specifically designed, have been developed. However, while many developments have been made, it has often created challenges to find effective printable recording media. Accordingly, investigations continue into developing such media substrates.

BRIEF DESCRIPTION OF THE DRAWING

The drawings illustrate various examples of the present recording media and are part of the specification.

DETAILED DESCRIPTION

Figure 1:
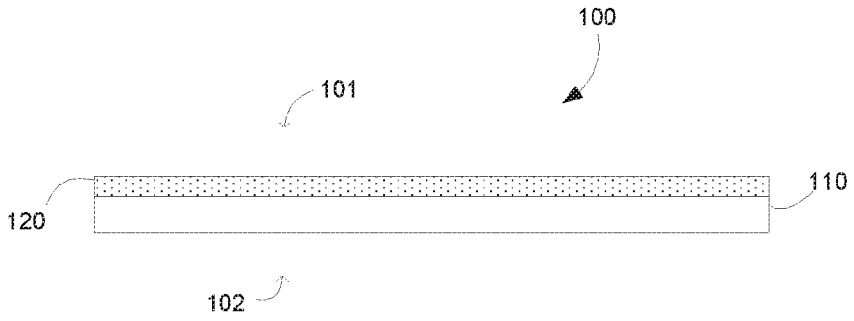
FIGS. 1 and 2 are cross-sectional views of the printable recording media according to examples of the present disclosure.

Before particular examples of the present disclosure are disclosed and described, it is to be understood that the present disclosure is not limited to the particular process and materials disclosed herein. It is also to be understood that the terminology used herein is used for describing particular examples only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. Percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The present disclosure refers to printable recording media containing a base substrate and a coating layer including a fixative agent and a binder system including a combination of water-soluble binder and water-dispersible binder. The present disclosure refers also to a method for making the printable recording media.

The printable recording media, described herein, provides printed images that demonstrate excellent image quality (good bleed and coalescence performance) and enhance durability performance while enabling high-speed and very high-speed printing. By high-speed printing, it is meant herein that the printing method can be done at a speed of 50 fpm or higher. As durability performance, it is meant herein that the resulting printed images are robust to dry and wet rubbing that can be done by going through finishing equipment (slitting, sheeting, folding, etc.) or by the user.

The printable recording media according to the present disclosure provides printed images that have outstanding print durability and excellent scratch resistance while maintaining good jettability. By scratch resistance, it is meant herein that the composition is resistant to any modes of scratching which include, scuff, abrasion and burnishing. By the term "scuff", it is meant herein damages to a print due to dragging something blunt across it (like brushing fingertips along printed image). Scuffs do not usually remove colorant but they do tend to change the gloss of the area that was scuffed. By the term "abrasion", it is meant herein the damage to a print due to wearing, grinding or rubbing away due to friction. Abrasion is correlated with removal of colorant (i.e. with the OD loss). An extreme abrasive failure would remove so much colorant that the underlying white of the paper would be revealed. The term "burnishing" refers herein to changing the gloss via rubbing. A burnishing failure appears as an area of differential gloss in a print. In some examples, the printable recording media described herein is a coated media that can be printed at speeds needed for commercial and other printers such as, for example, a HP Inkjet Web Press (HP Inc., Palo Alto, Calif., USA).

In addition, the printable media has a fast absorption rate. By "fast absorption rate", it is meant that the water, solvent and/or vehicle of the ink can be absorbed by the media at a fast rate so that the ink composition does not have a chance to interact and cause bleed and/or coalescence issues. The faster the printing speed and the higher the amount of ink used, the higher is the demand on faster absorption from the media. A good diagnostic plot with maximum ink density would be prone to coalescence and a pattern of lines of primary and secondary colors passing through area fills of primary and secondary colors would be prone to bleed. If no bleed or coalescence is present at the desired printing speed, the absorption rate would be sufficient. Bristow wheel measurements can be used for a quantitative measure of absorption on media wherein a fixed amount of a fluid is applied through a slit to a strip of media that moves at varying speeds.

Figure 2:
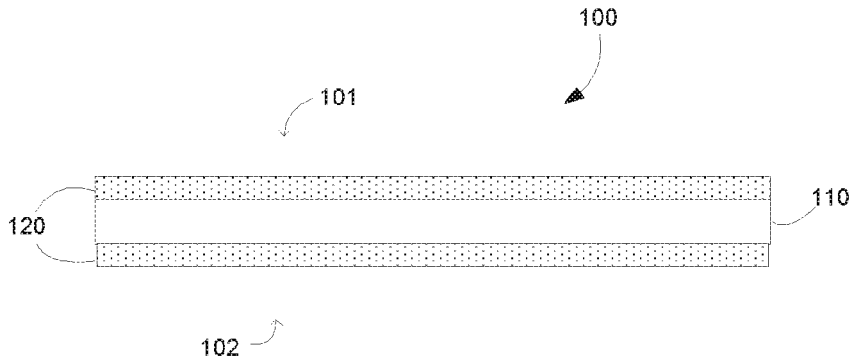
Figure 3:
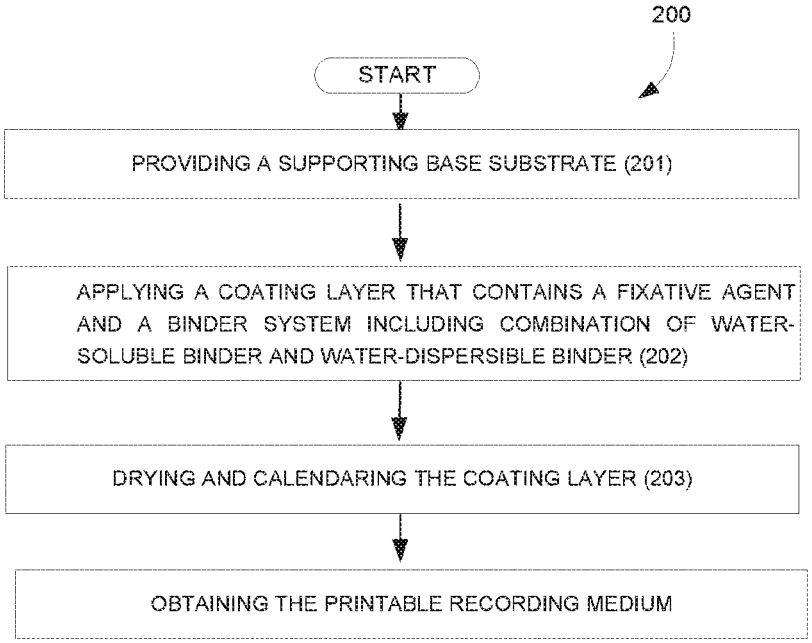
FIG. 3 is a flowchart illustrating a method for making the printable medium according to examples of the present disclosure.

FIG. 1 and FIG. 2 schematically illustrate some examples of printable recording media (100). FIG. 3 is a flowchart illustrating an example of a method for producing the printable recording media (100). As will be appreciated by those skilled in the art, FIG. 1 and FIG. 2 illustrate the relative positioning of the various layers of the printable media or printed article without necessarily illustrating the relative thicknesses of the various layers. It is to be understood that the thickness of the various layers is exaggerated for illustrative purposes.

As illustrated in FIG. 1, the printable media (100) encompasses a supporting base substrate or bottom supporting substrate (110) and a coating layer (120). The coating layer (120) is applied on one side of the supporting base substrate (110). The base substrate has two surfaces: a first surface, which is coated with image-receiving layer which might be referred to as the "image receiving side", "image surface" or "image side" (101), and a second surface, the opposite surface, which might be referred to as the "back surface" or "backside" (102). If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer. In some examples, such as illustrated in FIG. 2, the coating layer (120) is applied to both opposing sides of the supporting substrate (110). The double-side coated media has thus a sandwich structure, i.e. both sides of the supporting substrate (110) are coated and both sides may be printed.

FIG. 3 illustrates an example of a method (200) for making a printable recording media comprising: providing (201) a base substrate; applying (202) a coating layer that contains a fixative agent and a binder system including a combination of water-soluble binder and water-dispersible binder; and drying and calendaring (203) said coating layer.

The Printable Media (100)

The Supporting Base Substrate (110)

As illustrated in FIG. 1, the printable media (100) contains a base substrate, or supporting substrate, (110) having a coating layer that contains a fixative agent and a binder system including a combination of water-soluble binder and water-dispersible binder. In some examples the coating layer is applied on the image side (101) of the base substrate (110). In some other example, the coating layer is applied on the image side (101) and to the back-side of the base substrate (110). The printable media (100) contains a base substrate or supporting substrate (110) that acts as a bottom substrate layer. The base substrate or supporting substrate (i.e., 'substrate') contains a material that serves as a base upon which the ink-receiving layer is applied. The print media substrate provides integrity for the resultant print medium. The supporting base substrate or raw base substrate (110), on which coating compositions are applied, may take the form of a media sheet or a continuous web suitable for use in a printer. The supporting substrate may be a base paper that can be manufactured from cellulose fibers. The base paper may be produced from chemical pulp, mechanical pulp, thermal mechanical pulp and/or the combination of chemical and mechanical pulp. In some instances, when mechanical pulp is added, the total percentage of mechanical pulp is less than 20% of the total raw base weight. The base paper may also include conventional additives such as retention aid, dry or wet strength agent, internal sizing agents and fillers.

The base substrate may include any materials which can support a coating composition, for example, natural materials (such as a base including cellulose fibers) or synthetic material, (such as a base including synthetic polymeric fibers) or non-fabric materials (such as a polymeric film) or a mixture of them. The base substrate material has good affinity and good compatibility for the ink that is applied to the material. Examples of substrates include, but are not limited to, natural cellulosic material, synthetic cellulosic material (such as, for example, cellulose diacetate, cellulose triacetate, cellulose propionate, cellulose butyrate, cellulose acetate butyrate and nitrocellulose), material including one or more polymers such as, for example, polyolefins, polyesters, polyamides, ethylene copolymers, poly carbonates, polyurethanes, poly-alkylene oxides, polyester amides, polyethylene terephthalate, polyethylene, polystyrene, polypropylene, polycarbonate, polyvinyl acetal, poly-alkyloxazolines, poly-phenyl oxazolines, polyethylene-imines, polyvinyl pyrrolidones, and combinations of two or more of the above. In some examples, the media substrate includes a paper base including paper, cardboard, paperboard, paper laminated with plastics, and paper coated with resin.

The supporting base substrate (110) can be a cellulose base paper. The raw base substrate (110) can be made of any suitable wood or non-wood pulp. Non-limitative examples of suitable pulps include any kind of chemical pulp, mechanical wood pulp, chemically treated ground pulp, CTMP (chemical thermo-mechanical pulp), and/or mixtures thereof. Bleached hardwood chemical pulps may make up the main pulp composition. This pulp has shorter fiber structure than soft wood, which contribute to good formation of the finished paper. In some examples, the raw base substrate (110) contains 100% of chemically treated fiber such as bleached hardwood, softwood fiber, non-wood fiber, synthetic fiber, and combinations. In some other examples, the raw base substrate (110) contains 100% of bleached hardwood and, in yet some other examples, the raw base substrate (110) contains from about 50 to about 95% of bleached hardwood and from about 5 to about 50 wt % of softwood.

Fillers may be incorporated into the pulp, for example, to substantially control physical properties of the final coated paper. The filler particles fill in the void spaces of the fiber network and result in a denser, smoother, brighter and opaque sheet. Examples of the fillers include, but are not limited to, ground calcium carbonate, precipitated calcium carbonate, titanium dioxide, kaolin clay, silicates, plastic pigment, alumina trihydrate, magnesium oxide and/or mixtures thereof. In some examples, the supporting base substrate contains fillers in an amount ranging from about 0.1 wt % to about 30 wt % of the raw base, and in some other examples, the amount of filler ranges from about 5 wt % to about 15 wt % of the raw base.

When preparing the paper base stock, internal and surface sizing may be used. This process may improve internal bond strength of the substrate fibers, and may control the resistance of the coated substrate to wetting, penetration, and absorption of aqueous liquids. Internal sizing may be accomplished by adding a sizing agent to the raw base in the wet end. Non-limitative examples of suitable sizing agents include rosin-based sizing agent(s), wax-based sizing agent (s), cellulose-reactive sizing agent(s) and other synthetic sizing agent(s), and/or mixtures. In some examples, the internal sizing agents are Alkyl Ketene Dimer (AKD) or alkenyl-succinic anhydride (ASA). It is to be understood that the type and amount of surface sizing agent(s) may substantially improve moisture resistance and may alter the stiffness of the base paper stock. Surface sizing (i.e. apply sizing agent to the paper surface during papermaking process) may be accomplished by film size press, pond size press and other surface techniques. Included in this wet end processing can be additional functional additives such as but not limited to dispersants, biocides, retention aids, defoamers, dyes, and optical brighteners. The raw base substrate (110) can also be surfaced treated with starch or with starch and latex binder with pigments. The surface sizing agent might result in a coat-weight of sizing agent is the range of about 0.2 gsm to about 5 gsm.

In some examples, the raw base substrate has a basis weight of about 40 to about 300 gsm, and, in some other examples, has a basis weight of about 60 to about 120 gsm.

The Coating Layer (120)

The printable media contains a coating layer (120) disposed onto the base substrate (110). In some example, the coating layer (120) is directly applied above the supporting substrate (110), on the image side (101) of the printable medium. In some other examples, the coating layer (120) is present on both side of the base substrate (110). The coating layer (120) includes a fixative agent and a binder system including a combination of water-soluble binders and water-dispersible binders. In some examples, the coating layer (120) is disposed on the supporting base substrate (110) and forms a coating layer having a coat-weight in the range of about 0.1 to about 10 grams per square meter (g/m2 or gsm) per side. In some other examples, the coat-weight of the coating layer (120) of the printable medium is within a range of about 0.5 gsm to about 5 gsm per side. In yet some other examples, the coat-weight of the coating layer (120) of the printable medium is within a range of about 0.5 gsm to about 2 gsm per side. In yet some other examples, the coat-weight of the coating layer (120) of the printable medium is within a range of about 0.8 gsm to about 1.2 gsm per side. The thickness of the coating layer (120) may range from about 0.1 micron (μm) to about 20 micron (μm) out of the top surface of the supporting substrate.

The coating layer (120) includes a fixative or fixing agent. It is believed that the fixing agent can chemically, physically, and/or electrostatically bind a marking material, such as an inkjet ink, at or near an outer surface of the coated print medium to provide acceptable water-fastness, smear-fastness, and overall image stability. A function of the fixative agent can be thus to reduce ink dry time.

In some examples, the fixative agent is present in the coating composition in an amount representing from about 20 to about 60 weight percent (wt %) of the total weight of the coating composition. In some other examples, the fixative agent is present in the coating composition in an amount representing from about 30 to about 50 weight percent (wt %) of the total weight of the coating composition (based on total dry weight or solids of the coating composition).

In some examples, the coating layer (120) includes a fixative agent and a binder system wherein the ratio of fixative agent to binder system is from about 1:5 to about 5:1. In some other examples, the coating layer includes a fixative agent and a binder system wherein the ratio of fixative agent to binder system is from about 1:2 to about 2:1.

The fixative agents can be a metallic salt, a cationic amine polymer, a quaternary ammonium salt, or a quaternary phosphonium salt. The metallic salt may be a water-soluble mono- or a multi-valent metallic salt. The water-soluble metallic salt can be an organic salt or an inorganic salt. The fixative agent can be an inorganic salt. In some examples, the fixative agent is a water-soluble and multi-valent charged salts. Multi-valent charged salts include cations, such as Group I metals, Group II metals, Group III metals, or transition metals, such as sodium, calcium, copper, nickel, magnesium, zinc, barium, iron, aluminum and chromium ions. The associated complex ion can be chloride, iodide, bromide, nitrate, sulfate, sulfite, phosphate, chlorate, acetate ions. The fixative agent can be an organic salt; in some examples, the fixative agent is a water-soluble organic salt; in yet some other examples, the fixative agent is a water-soluble organic acid salt. Organic salt refers to associated complex ion that is an organic specifies, where cations may or may not the same as inorganic salt like metallic cations. Organic metallic salt are ionic compounds composed of cations and anions with a formula such as $(C_nH_{2n+1}COO^- M^+)*(H_2O)_m$ where $M^+$ is cation species including Group I metals, Group II metals, Group III metals and transition metals such as, for example, sodium, potassium, calcium, copper, nickel, zinc, magnesium, barium, iron, aluminum and chromium ions. Anion species can include any negatively charged carbon species with a value of n from 1 to 35. The hydrates ($H_2O$) are water molecules attached to salt molecules with a value of m from 0 to 20. Examples of water-soluble organic acid salts include metallic acetate, metallic propionate, metallic formate, metallic oxalate, and the like. The organic salt may include a water-dispersible organic acid salt. Examples of water-dispersible organic acid salts include a metallic citrate, metallic oleate, metallic oxalate, and the like.

In some examples, the fixative agent is a water-soluble, divalent or multi-valent metal salt. Specific examples of the divalent or multi-valent metal salt used in the coating include, but are not limited to, calcium chloride, calcium acetate, calcium nitrate, calcium pantothenate, magnesium chloride, magnesium acetate, magnesium nitrate, magnesium sulfate, barium chloride, barium nitrate, zinc chloride, zinc nitrate, aluminum chloride, aluminum hydroxy-chloride, and aluminum nitrate. Divalent or multi-valent metal salt might also include $CaCl_2$, $MgCl_2$, $MgSO_4$, $Ca(NO_3)_2$, and $Mg(NO_3)_2$, including hydrated versions of these salts. In some examples, the water-soluble divalent or multi-valent salt can be selected from the group consisting of calcium acetate, calcium acetate hydrate, calcium acetate monohydrate, magnesium acetate, magnesium acetate tetrahydrate, calcium propionate, calcium propionate hydrate, calcium gluconate monohydrate, calcium formate and combinations thereof. In some examples, the fixative agent is calcium chloride and/or calcium acetate. In some other examples, the fixative agent is calcium chloride ($CaCl_2$).

The coating layer (120) comprises a binder system including a combination of water-soluble binder and a water-dispersible binder. Without being linked by any theory, it is believed that the binder system is selected to exhibit good binding power to the base paper stock and pigments, and providing good durability for final printed media as well.

In some examples, the binder system, including a combination of water-soluble binder and a water-dispersible binder, is present in the coating composition in an amount representing from about 20% to about 95% weight percent (Wt %) of the total weight of the coating composition. In some other examples, the binder system is present in the coating composition in an amount representing from about 40% to about 80% weight percent (Wt %) of the total weight of the coating composition (based on total dry weight or solids of the coating composition). In some examples, the coating layer (120) includes a binder system having a ratio of water-dispersible binder to water-soluble binder that is from about 1:1 to about 15:1. In some other examples, the coating layer includes a binder system having a ratio of water-dispersible binder to water-soluble binder that is from about 5:1 to about 10:1.

The coating layer (120) comprises a binder system including water-soluble binders. The term "water-soluble" refers herein to binders that are capable of being dissolve in water. The water-soluble binder can be polyvinyl alcohol, a starch derivative, gelatin, a cellulose derivative, a copolymer of vinylpyrrolidone or an acrylamide polymer for examples. In some examples, the water-soluble binder can be a polyvinyl alcohol or a copolymer of vinylpyrrolidone. In yet some examples, the water-soluble binder is a polyvinyl alcohol. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinyl-acetates, vinylimidazole, vinylpyridine, vinyl-caprolactams, methyl vinyl-ether, maleic anhydride, vinyl-amides, vinyl-chloride, vinylidene chloride, dimethyl-aminoethyl methacrylate, acrylamide, methacrylamide, acrylonitrile, styrene, acrylic acid, sodium vinyl-sulfonate, vinyl-propionate, and methyl vinyl-ketone, etc. In some examples, the copolymer of vinylpyrrolidone can be a copolymer of vinylpyrrolidone and vinyl-acetate or vinyl-caprolactam or polyvinyl-alcohol. The polyvinyl-alcohol or copolymer of vinylpyrrolidone can have a weight average molecular weight ranging from about 10,000 Mw to about 1,000,000 Mw or can have a weight average molecular weight ranging from about 20,000 Mw to about 500,000 Mw. In some examples, the binder is a polyvinyl-alcohol having a molecular length in the range of 20,000 to 500,000.

Examples of water-soluble binders may include, for example, a combination of polyvinyl alcohol with methanol sold under the trade name Mowiol®6-98 (available from Kuraray America, Inc.); a polyvinyl alcohol sold under the trade name Mowiol®18-88 (available from Kuraray America, Inc.); or 2-hydroxyethyl starch ether sold under the tradename of Penford® Gum 280 (available from Penford Products Co).

The coating layer (120) comprises a binder system including water-dispersible binders. The term "water-dispersible" refers herein to binders that are not capable of being dissolve in water and which remains in suspension in water. The water-dispersible binder can be acrylic polymers or copolymers, vinyl acetate latex, polyesters, vinylidene chloride latex, styrene-butadiene or acrylonitrile-butadiene copolymers. In some examples, the water-dispersible polymeric binder is a latex binder selected from the group consisting of polybutadiene latex, styrene-butadiene copolymer latex, acrylonitrile-butadiene-styrene terpolymer latex, polychloroprene latex, acrylic latex, polyester emulsions, acrylonitrile-butadiene latex, polyvinyl acetate and polyvinyl acetate copolymers. In some other examples, the water-dispersible polymeric binder is styrene-butadiene copolymer latex. In yet some other examples, the polymeric binder is a carboxylated styrene/butadiene copolymer. In some examples, the water-dispersible binders have a glass transition temperature (Tg) within the range of about −20° C. to about 35° C. In some other examples, the Tg of the water-dispersible binders is from −5° C. to 25° C.

Examples of such water-dispersible polymers include, for example, styrene-butadiene latex such as Gencryl®9780 (available from Omnova Solution Inc.), XU31258.50 (available from Styron Inc.), Litex® PX 9330 or Litex® PX 9740 (from Synthomer). Other examples of water-dispersible binders may include also an acrylic polymer sold under the trade name Raycryl® 48083 (available from Specialty Polymers); an aqueous dispersion of an n-butyl acrylate-acrylonitrile-styrene copolymer commercially available under the tradename Acronal® S 504 (available from BASF); a styrene/n-butyl acrylate copolymer Acronal® S 728 (available from BASF).

In some examples, the coating layer (120) can further include, as an optional ingredient, a water-soluble cationic polymeric compound. Examples of such cationic polymer include poly-diallyl-dimethyl-ammonium chloride, poly-diallyl-amine, polyethylene imine, poly2-vinylpyridine, poly 4-vinylpyridine poly2-(tert-butylamino)ethyl methacrylate, poly 2-aminoethyl methacrylate hydrochloride, poly 4'-diamino-3,3'-dinitrodiphenyl ether, poly N-(3-aminopropyl) methacrylamide hydrochloride, poly 4,3,3'-diaminodiphenyl sulfone, poly 2-(iso-propyl-amino)ethyl styrene, poly2-(N,N-diethylamino)ethyl methacrylate, poly 2-(diethylamino) ethyl styrene, and 2-(N,N-dimethyl-amino)ethyl acrylate.

In some examples, the coating layer (120) can further include a dispersant. In some other examples, the coating layer can further include a pigment. The pigment may be a calcined clay, kaolin clay, precipitated calcium carbonate (PCC), modified calcium carbonate (MCC), calcium sulfate, TiO2, talc, etc. The dispersant, if included, is to disperse the various components as well as contribute to the stability of the pre-coat fluid. Examples of suitable dispersants include polyacrylated salt and polycarboxylated salt. The coating layer (120) may also include a pigment, such as a calcined clay, to assist in controlling the ink penetration and to enhance gloss of the printed image.

Method for Making the Printable Recording Material

In some examples, according to the principles described herein, a method of making a printable recording media comprising a supporting base substrate (110) and a coating layer (120) is provided. Such method encompasses: providing a base substrate (110); applying a coating layer (120) that contains a fixative agent and a binder system including a combination of water-soluble binder and water-dispersible binder; drying and calendaring said coating layer.

In some examples, the coating layer (120) is applied to the base substrate (110) on the image receiving side of the printable media. In some other examples, the coating layer (120) is applied to the supporting base substrate (110) on the image receiving side (101) and on the backside (102) of the printable media. The coating layer (120) can be applied to the base substrate (110) by using one of a variety of suitable coating methods, for example blade coating, air knife coating, metering rod coating, size press, curtain coating, or another suitable technique. In some examples, the coating layers can be applied in one single production run. When the coating layer are present on both sides of the base substrates, depending on set-up of production machine in a mill, both sides of the substrate may be coated during a single manufacture pass, or each side is coated in a separate pass.

In some examples, after the coating step, the media might go through a drying process to remove water and other volatile components present in the coating layers and substrate. The drying pass may comprise several different drying zones, including, but not limited to, infrared (IR) dryers, hot surface rolls, and hot air floatation boxes. In some other examples, after the coating step, the coated web may receive a glossy or satin surface with a calendering or super calendering step. When a calendering step is desired, the coated product passes an on-line or off-line calender machine, which could be a soft-nip calender or a super-calender. The rolls, in the calender machine, may or may not be heated, and certain pressure can be applied to calendering rolls. In addition, the coated product may go through embosser or other mechanical roller devices to modify surface characteristics such as texture, smoothness, gloss, etc. In some examples, the coating layer is associated with the print media. The phrase "associated with" means that a layer is, for example, formed on, coated on, adsorbed on or absorbed in at least one surface of the print media substrate. The association between a layer and a surface of the print media substrate is achieved by bringing the substrate and composition forming the layer into contact by, for example, spraying, dipping and coating (including, e.g., roll, blade, rod, slot die, or curtain coating).

When the base substrate is base paper stock, the composition for forming the coating layer can be applied on the base paper stock by an in-line surface size press process such as a puddle-sized press or a film-sized press, for example. In addition to in-line surface sizing processing, off-line coating technologies can also be used to apply the composition for forming the coating layer to the print media substrate. Examples of suitable coating techniques include, but are not limited to, slot die coaters, roller coaters, fountain curtain coaters, blade coaters, rod coaters, air knife coaters, gravure applications, and air brush applications, for example.

Method for Producing Printed Images

The method for producing printed images, or printing method, includes providing a printable recording media such as defined herein; applying an ink composition on the coating layer of the print media, to form a printed image; and drying the printed image in order to provide, for example, a printed image with enhanced quality and enhanced image permanence. The printable recording media contains a base substrate and a coating layer including a fixative agent and a binder system including a combination of water-soluble binder and water-dispersible binder. In some examples, the printing method for producing images is an inkjet printing method. By inkjet printing method, it is meant herein a method wherein a stream of droplets of ink is jetted onto the recording substrate or media to form the desired printed image. The ink composition may be established on the recording media via any suitable inkjet printing technique. Examples of inkjet method include methods such as a charge control method that uses electrostatic attraction to eject ink, a drop-on-demand method which uses vibration pressure of a Piezo element, an acoustic inkjet method in which an electric signal is transformed into an acoustic beam and a thermal inkjet method that uses pressure caused by bubbles formed by heating ink. Non-limitative examples of such inkjet printing techniques include thus thermal, acoustic and piezoelectric inkjet printing. In some examples, the ink composition is applied onto the recording media using inkjet nozzles. In some other examples, the ink composition is applied onto the recording method using thermal inkjet printheads.

In some examples, the printing method is a capable of printing more than about 50 feet per minute (fpm) (i.e. has a print speed that is more than about 50 fpm). The printing method described herein can be thus considered as a high-speed printing method. The web-speed could be from about 100 to about 4000 feet per minute (fpm). In some other examples, the printing method is a printing method capable of printing from about 100 to about 1000 feet per minute. In yet some other examples, the printing method is capable of printing at a web-speed of more than about 200 feet per minute (fpm). In some example, the printing method is a high-speed web press printing method. As "web press", it is meant herein that the printing technology encompasses an array of inkjet nozzles that span the width of the paper web. The array is thus able, for example, to print on 20", 30", and 42" wide web or on rolled papers.

In some examples, the printing method as described herein prints on one-pass only. The paper passes under each nozzle and printhead only one time as opposed to scanning type printers where the printheads move over the same area of paper multiple times and only a fraction of total ink is used during each pass. The one-pass printing puts 100% of the ink from each nozzle/printhead down at once and is therefore more demanding on the ability of the paper to handle the ink in a very short amount of time.

As mentioned above, a print media in accordance with the principles described herein may be employed to print images on one or more surfaces of the print media. In some examples, the method of printing an image includes depositing ink that contains particulate colorants. A temperature of the print media during the printing process is dependent on one or more of the nature of the printer, for example. Any suitable printer may be employed such as, but not limited to, offset printers and inkjet printers. In some examples, the printer is a HP T350 Color Inkjet Webpress printer (Hewlett Packard Inc.). The printed image may be dried after printing. The drying stage may be conducted, by way of illustration and not limitation, by hot air, electrical heater or light irradiation (e.g., IR lamps), or a combination of such drying methods. In order to achieve best performances, it is advisable to dry the ink at a maximum temperature allowable by the print media that enables good image quality without deformation. Examples of a temperature during drying are, for examples, from about 60° C. to about 205° C., or from about 120° C. to about 180° C. The printing method may further include a drying process in which the solvent (such as water), that can be present in the ink composition, is removed by drying. As a further step, the printable recording media can be submitted to a hot air drying systems. The printing method can also encompass the use of a fixing agent that will retain with the pigment, present in the ink composition that has been jetted onto the media.

Example 1—Preparation of the Media

Coating layer formulations 1 to 5 are prepared by mixing the ingredients as illustrated in table 1. Chemicals are mixed together in a tank by using normal stirring equipment. Each coating layer compositions 1 to 5 is applied on the on the image side of a raw base substrate (110) at a coat-weight of about 1 gram/square meter (gsm) using a Meyer rod in lab in view of obtaining media samples I to V. The raw base is made with base paper stock prepared with cellulose fibers. Such base paper stock contains about 60% of hardwood, about 20% of softwood and about 10% of calcium carbonate fillers. The recording media are then calendered through a lab soft nip calendar machine (at 2000 psi at room temperature).

TABLE 1

| Formula | | Example 1 (comparative) | Example 2 | Example 3 | Example 4 | Example 5 |
|---|---|---|---|---|---|---|
| Mowiol ® 18-88 | water-soluble binder (PVOH) | 60.0 | 30.0 | 20.0 | 10.0 | 5.0 |
| Litex ® PX 9740 | water-dispersible binder (SBR Latex) | — | 30.0 | 40.0 | 50.0 | 65.0 |
| CaCl2 | Salt | 40.0 | 40.0 | 40.0 | 40.0 | 30.0 |

Example 2—Printable Recording Media Performances

The media samples I to V are printed using an HP CM8060 MFP with webpress inkjet inks (A50) in the pens.

The prints are obtained after in 2 pass/6 dry spin mode. The resulting printed samples are then evaluated for their durability/resistance and KOD performances. The results of these tests are illustrated in Table 2.

The KOD (black optical density) is evaluated using a X-Rite Spectro-densitometer. Resistance tests are performed onto the obtained printed media. The printed media sample are tested for durability immediately after printing. The resistance test refers to the ability of a printed image to resist appearance degradation upon rubbing the image. Good resistance, upon rubbing, will tend to not transfer ink from a printed image to surrounding areas where the ink has not been printed. In the "Finger Smudge" test, a wet finger is placed on the print with sufficient force to bend at the knuckle and drawn down. Each durability testing item is then given a rating score according to a 1 to 5 scale, as described in the Table 3 below, wherein 1 means the worst performance (all the ink in the image has been removed), and 5 represents the best performance (the image shows no damage).

According to such results, it can be seen that the media with the coating composition of the present disclosure provides the best overall scores on durability.

TABLE 2

| Performances | Media I (comparative) | Media II | Media III | Media IV | Media V |
|---|---|---|---|---|---|
| KOD | 1.29 | 1.29 | 1.29 | 1.29 | 1.29 |
| Durability | 2 | 3 | 3.5 | 4 | 4 |

The invention claimed is:

1. A printable recording media comprising a base substrate and a coating layer, wherein the coating layer includes from about 30 wt % to about 50 wt % of a fixative agent selected from a metallic salt, a quaternary ammonium salt, or a quaternary phosphonium salt, and from about 40 wt % to about 80 wt % of a binder system including a combination of water-dispersible binder and a water soluble binder, wherein a ratio of the water-dispersible binder to the water soluble binder is from 5:1 to 10:1.

2. The printable recording media according to claim 1 wherein the coating layer has a coat-weight ranging from about 0.1 gsm to about 10 gsm.

3. The printable recording media according to claim 1 wherein the coating layer is applied to both opposing sides of the base substrate.

4. The printable recording media according to claim 1 wherein the fixative agent is present in the coating composition in an amount representing from about 20 wt % to about 60 wt % of the total weight of the coating composition.

5. The printable recording media according to claim 1 wherein the ratio of fixative agent to binder system, in the coating layer, is from about 1:5 to about 5:1.

6. The printable recording media according to claim 1 wherein the fixative agent is a water-soluble, divalent or multi-valent metal salt.

7. The printable recording media according to claim 1 wherein the fixative agent is calcium chloride.

8. The printable recording media according to claim 1 wherein the water-soluble binder is a polyvinyl alcohol, a starch derivative, gelatin, a cellulose derivative, a copolymer of vinylpyrrolidone or an acrylamide polymer.

9. The printable recording media according to claim 1 wherein the water-soluble binder is a polyvinyl alcohol or a copolymer of vinylpyrrolidone.

10. The printable recording media according to claim 1 wherein the water-dispersible binder is acrylic polymer or copolymer, vinyl acetate latex, polyester, vinylidene chloride latex, styrene-butadiene or acrylonitrile-butadiene copolymer.

11. The printable recording media according to claim 1 wherein the water-dispersible binder is a styrene-butadiene copolymer latex.

12. The printable recording media according to claim 1 wherein the coating layer further includes a water-soluble cationic polymeric compound and wherein the water-soluble cationic polymeric compound is selected from poly-diallylamine, poly2-vinylpyridine, poly 4-vinylpyridine poly2-(tert-butylamino)ethyl methacrylate, poly 2-aminoethyl methacrylate hydrochloride, poly 4'-diamino-3,3'-dinitrodiphenyl ether, poly N-(3-aminopropyl)methacrylamide hydrochloride, poly 4,3,3'-diaminodiphenyl sulfone, poly 2-(iso-propyl-amino)ethyl styrene, poly2-(N,N-diethyl-amino)ethyl methacrylate, poly 2-(diethylamino)ethyl styrene, or 2-(N,N-dimethyl-amino)ethyl acrylate.

13. A method for making a printable recording media comprising:

providing a base substrate;

applying a coating layer that contains from about 30 wt % to about 50 wt % of a fixative agent and from about 40 wt % to about 80 wt % of a binder system including a combination of water-soluble binder and water-dispersible binder wherein the fixative agent is selected from a metallic salt, a quaternary ammonium salt, or a quaternary phosphonium salt, and wherein a ratio of the water-dispersible binder to the water soluble binder is from 5:1 to 10:1; and drying and calendaring said coating layer.

14. The printable recording media according to claim 1 wherein the coating layer has a coat-weight ranging from about 0.8 gsm to about 1.2 gsm.

15. The printable recording media according to claim 1 wherein the water-soluble binder is a vinylpyrrolidone copolymer.

16. The printable recording media according to claim 1 wherein the water-dispersible binder is a polychloroprene latex.

17. The printable recording media according to claim 1 wherein the coating layer further includes a pigment and the pigment is calcium sulfate, TiO2, or the combination thereof.

18. The printable recording media according to claim 1, wherein the coating layer further includes a dispersant and the dispersant is a polyacrylated salt, polycarboxylated salt, or a combination thereof.

* * * * *